US005971862A

United States Patent [19]

Yates

[11] Patent Number: 5,971,862

[45] Date of Patent: Oct. 26, 1999

[54] APPARATUS FOR DISPENSING AND TEEING GOLF BALLS

[76] Inventor: Patrick D. Yates, 21417 Brewer Rd., Grass Valley, Calif. 95949

[21] Appl. No.: 09/047,616

[22] Filed: Mar. 25, 1998

[51] Int. Cl.[6] ..... A63B 57/00

[52] U.S. Cl. ..... 473/137

[58] Field of Search ..... 473/132, 133, 473/134, 135, 136, 137

[56] References Cited

U.S. PATENT DOCUMENTS

| | | | |
|---|---|---|---|
| 3,127,177 | 3/1964 | Benkoe | 473/137 |
| 3,378,263 | 4/1968 | Turnau et al. | 473/135 |
| 4,441,717 | 4/1984 | Willcox | 473/134 |
| 4,796,893 | 1/1989 | Choi | 473/137 |
| 4,957,296 | 9/1990 | Turnidge et al. . | |
| 5,269,519 | 12/1993 | Malone | 473/225 |
| 5,458,339 | 10/1995 | Wildes . | |
| 5,464,223 | 11/1995 | Dermott | 473/137 |
| 5,624,325 | 4/1997 | Smith | 473/137 |
| 5,647,805 | 7/1997 | Tarbox, Jr. . | |
| 5,674,130 | 10/1997 | Egan . | |

*Primary Examiner*—Steven Wong
*Attorney, Agent, or Firm*—Thomas R. Lampe

[57] ABSTRACT

Apparatus for serially dispensing and teeing golf balls includes tiltable meter mechanism disposed along a golf ball pathway for releasing balls one at a time. The apparatus also includes a golf ball supply tray having an opening and an anti-jam device for preventing golf ball bridging over the opening.

18 Claims, 6 Drawing Sheets

APPARATUS FOR DISPENSING AND TEEING GOLF BALLS

TECHNICAL FIELD

This invention relates to apparatus for dispensing and teeing golf balls.

BACKGROUND OF THE INVENTION

A number of prior art arrangements are known for automatically dispensing and teeing golf balls. Such arrangements, however, are generally characterized by their relative complexity. Also, some operational reliability problems exist, particularly with regard to golf ball jamming. Typically golf balls in such devices are dispensed from a hopper containing a plurality of golf balls and jamming can and does occur as individual balls exit the hopper. While anti-jamming mechanisms have been devised, the effectiveness thereof is not all one might wish.

The following United States patents illustrate golf ball dispenser devices which are believed to be representative of the current state of the prior art: U.S. Pat. No. 4,957,296, issued Sep. 18, 1990, U.S. Pat. No. 5,458,339, issued Oct. 17, 1995, U.S. Pat. No. 5,674,130, issued Oct. 7, 1997, U.S. Pat. No. 5,624,325, issued Apr. 29, 1997, and U.S. Pat. No. 5,647,805, issued Jul. 15, 1997.

DISCLOSURE OF INVENTION

The present invention relates to apparatus for serially dispensing and teeing golf balls, the apparatus being characterized by its relative simplicity and high reliability.

The apparatus includes a golf ball support for supporting a plurality of golf balls, the support defining a golf ball exit opening.

The apparatus also includes pathway defining means defining a pathway for golf balls for receiving golf balls exiting the golf ball exit opening and for delivering the golf balls to a predetermined location spaced from the golf ball exit opening.

Golf ball metering means is disposed along the pathway defining means between the predetermined location and the golf ball exit opening for engaging an end-most golf ball of a plurality of golf balls lined up along the pathway and actuatable to separate the end-most golf ball from the other golf balls lined up along the pathway.

Track means is movably mounted adjacent to the golf ball metering means, the track means having a distal end movable between an elevated position and a lowered position. The track means defines an aperture at the distal end thereof for receiving a golf ball from the metering means.

The apparatus further includes a tee and mounting means for the tee.

Actuator means is operatively associated with the golf ball metering means to actuate the golf ball metering means and cause the golf ball metering means to separate the end-most golf ball from the other golf balls lined up along the pathway and deliver the separated golf ball to the distal end of the track means and over the aperture when the distal end is in elevated position. In addition, the distal end is caused to move from elevated position to lowered position whereby the tee projects upwardly through the aperture and receives the separated golf ball from the distal end to transfer the separated golf ball from the track means to the tee.

The apparatus also includes an anti-jam golf ball engagement member movably mounted relative to the golf ball support for engaging and moving golf balls at the golf ball exit opening to prevent jamming of golf balls at the golf ball exit opening. The actuator means is operatively associated with the anti-jam golf ball engagement member to cause movement of the golf ball engagement member relative to the golf ball support.

Other features, advantages, and objects of the present invention will become apparent with reference to the following description and accompanying drawings.

BEST MODE FOR CARRYING OUT THE INVENTION

Figure 1:
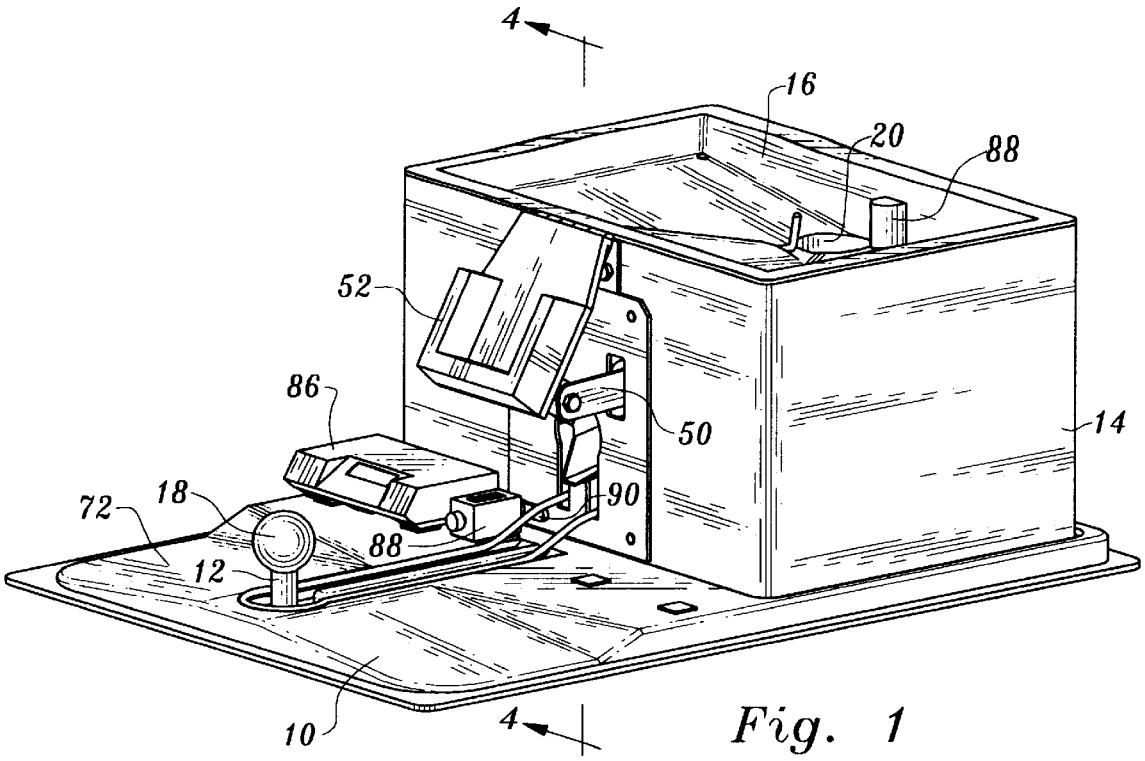
FIG. 1 is a perspective view of apparatus constructed in accordance with the teachings of the present invention in an inactive state, with a golf ball teed up on the apparatus tee.

Referring now to the drawings, apparatus constructed in accordance with the teachings of the present invention includes a base member 10 having a tee 12 mounted thereon and extending upwardly therefrom. The illustrated tee is in the form of a cylinder and the tee may suitably be formed of rubber or other yieldable material.

Attached to base member or tee mounting member 10 is a housing 14 defining a housing interior and having a tray 16 positioned at the upper end thereof. The tray operates as a golf ball support for supporting a plurality of golf balls 18. The tray defines a golf ball exit opening 20.

As can clearly be seen in the drawings, the tray 16 includes a plurality of tray walls sloping downwardly toward the golf ball exit opening. One of the tray walls, tray wall 22, includes laterally sloping surfaces 24 spaced from the golf ball exit opening for directing golf balls laterally relative to the path of movement of an anti-jam golf ball engagement member 26 positioned in an aperture formed in tray wall 22.

In a manner which will be more fully described below, member 26 moves between a retracted position (shown in FIGS. 6, 6A, for example) to an extended position (shown in FIGS. 5, 5A and 7B, for example). In the retracted position the distal end 28 of the member 26 is spaced from the golf ball exit opening. When the member 26 is in the extended position, the distal end thereof is positioned over the golf ball exit opening. The distal end 28 projects upwardly and laterally relative to the path of movement of the anti-jam golf ball engagement member 26 between the retracted end extended positions.

Positioned below golf ball exit opening 20 is an end of a conduit 30 which receives golf balls from the golf ball exit opening and defines a pathway for the golf balls. The conduit 30 is sized so that the golf balls entering the conduit are disposed in a line. A mechanism for metering the golf balls exiting conduit 30 is disposed at the exit end of the conduit. Such metering mechanism includes a rocker member 32 which is pivotally connected to an extension member 36 projecting from conduit 30. Golf balls 18 exiting conduit 30 will be supported by the extension member.

Figures 5, 5A:
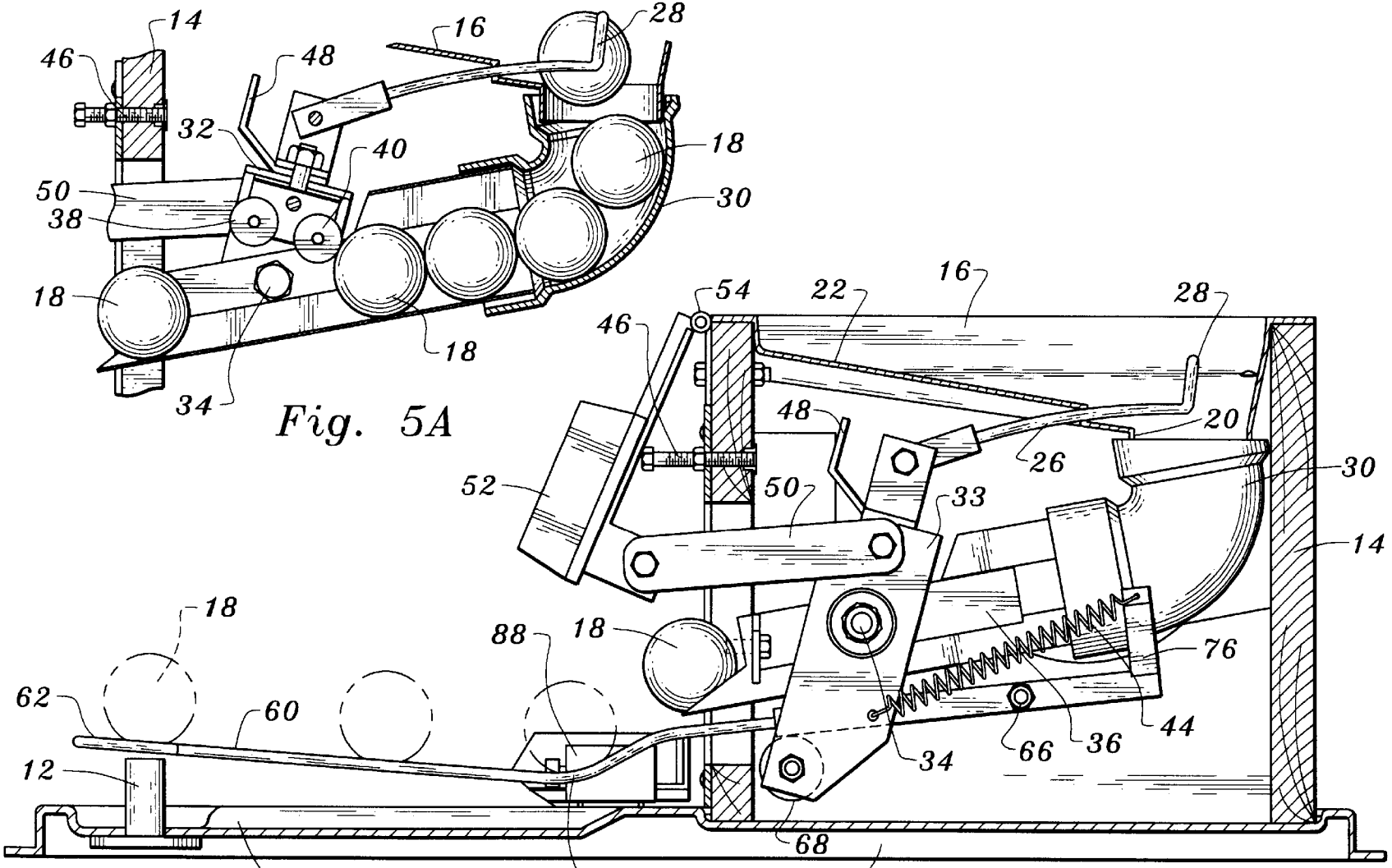
FIG. 5 is an enlarged cross-sectional view taken along the line 5—5 of FIG. 2.
FIG. 5A is a view similar to FIG. 4A but illustrating the golf ball metering mechanism and related structural components including anti-jam golf ball engagement member in the relative positions assumed thereby at the stage of operation depicted in FIG. 5.
Figures 6, 6A:
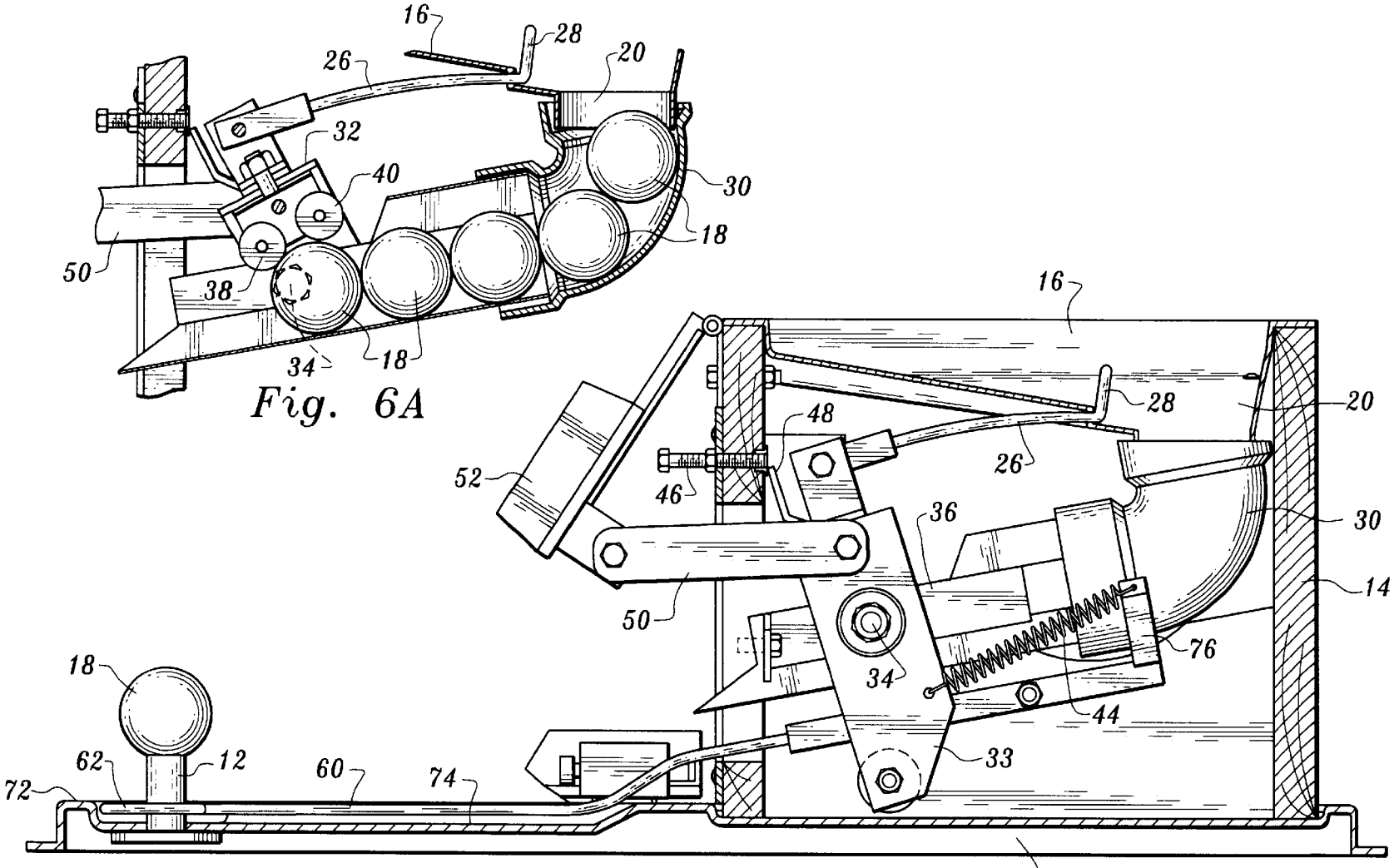
FIG. 6 is an enlarged cross-sectional view similar to FIGS. 4 and 5 but illustrating the relative positions assumed by structural components of the apparatus after a golf ball has been placed on the tee.
FIG. 6A is a view similar to FIGS. 4A and 5A, except that the metering mechanism is shown at its rest position awaiting actuation of the apparatus as depicted in FIG. 6.

The rocker member 32 tilts between two positions, the position shown in FIG. 5A and the position shown in FIG. 6A. The anti-jam golf ball engagement member 26 is attached to rocker member 32 and tilting of the rocker member moves the member 26 between the extended and retracted positions described above. Link arms 33 are attached to opposed sides of the rocker member 32 and extend downwardly therefrom. Stub pins 34 rotatably interconnect the link arms 33 to extension member 36.

Rotatably attached to rocker member 32 are rollers 38, 40 which are spaced from one another. When the rocker member 32 is in the position shown in FIG. 6A (the other components of the apparatus being in the positions shown in FIG. 6), the end-most or leading golf ball supported on extension member 36 will be engaged by roller 38. Roller 38 will prevent further downward movement on the inclined extension member of the end-most golf ball and of the other golf balls behind it under the influence of gravity. When, however, the rocker member is moved to the position shown in FIG. 5A through the intermediate position shown in FIG. 4A, the end-most golf ball will be released and will roll down the chute-like extension member 36. That is, the end-most golf ball will be separated from the remainder of the plurality of golf balls lined up behind it.

As the end-most golf ball is released, the next golf ball in line will engage roller 40 and be prevented from rolling down the extension member. In the cycle of operation of the apparatus, immediately after release of the end-most golf ball the rocker member 32 will return to the initial position shown in FIG. 6A and engagement will be had between the new end-most golf ball and roller 38. Such return motion is accomplished by a coil tension spring 44 which exerts a continuous pulling force on a link arm 33. Such pulling force continuously biases the link arm in a counter clockwise direction as viewed in FIGS. 4, 5 and 6. An adjustment screw 46 projecting through housing 14 is engageable with a stop plate 48 attached to the rocker member 32 to adjust the degree of movement resulting from coil spring 44.

A pair of link members 50 project through openings formed in housing 14 and each is pivotally connected at one end thereof to the upper end of a link arm 33. The other end of each link member 60 is connected to club head engagement member 52 which is pivotally connected to the housing 14 by a hinge 54. Preferably the club head engagement member 52 includes a resilient club head engagement surface to prevent marring or blemishing of a club head.

Figure 2:
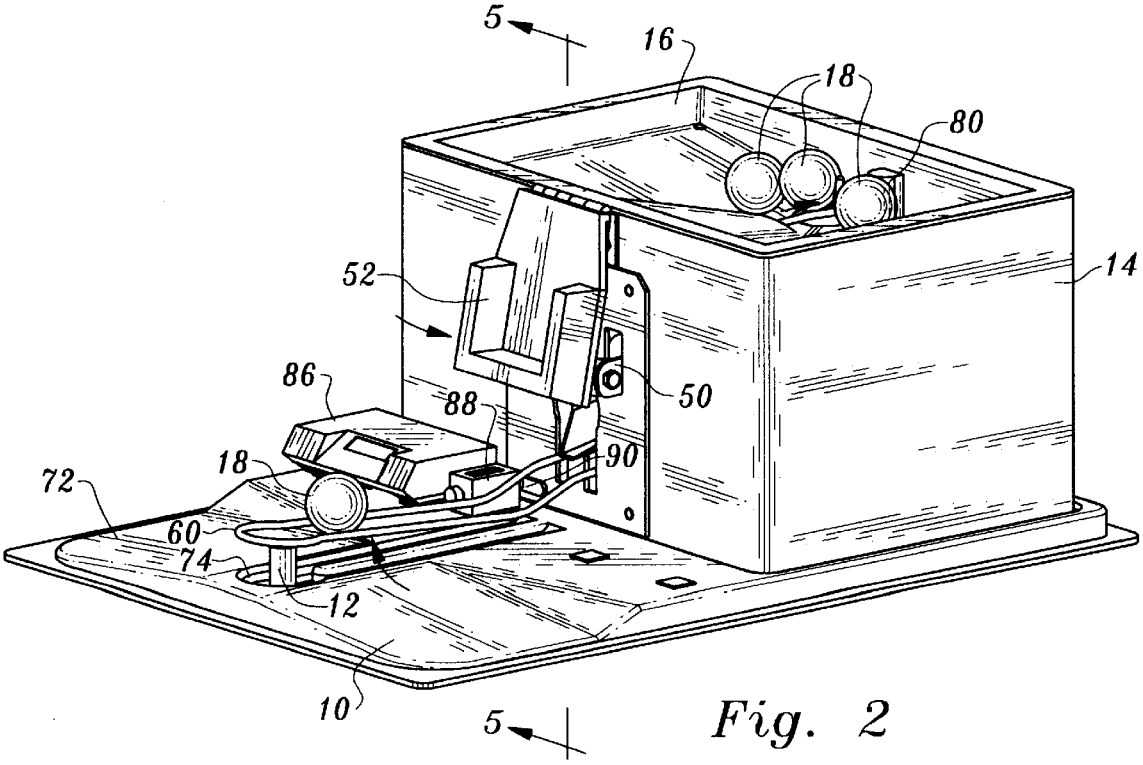
FIG. 2 is a view similar to FIG. 1 but illustrating relative positions assumed by components of the apparatus during a stage of operation thereof prior to placement of the ball on the tee.
Figure 3:
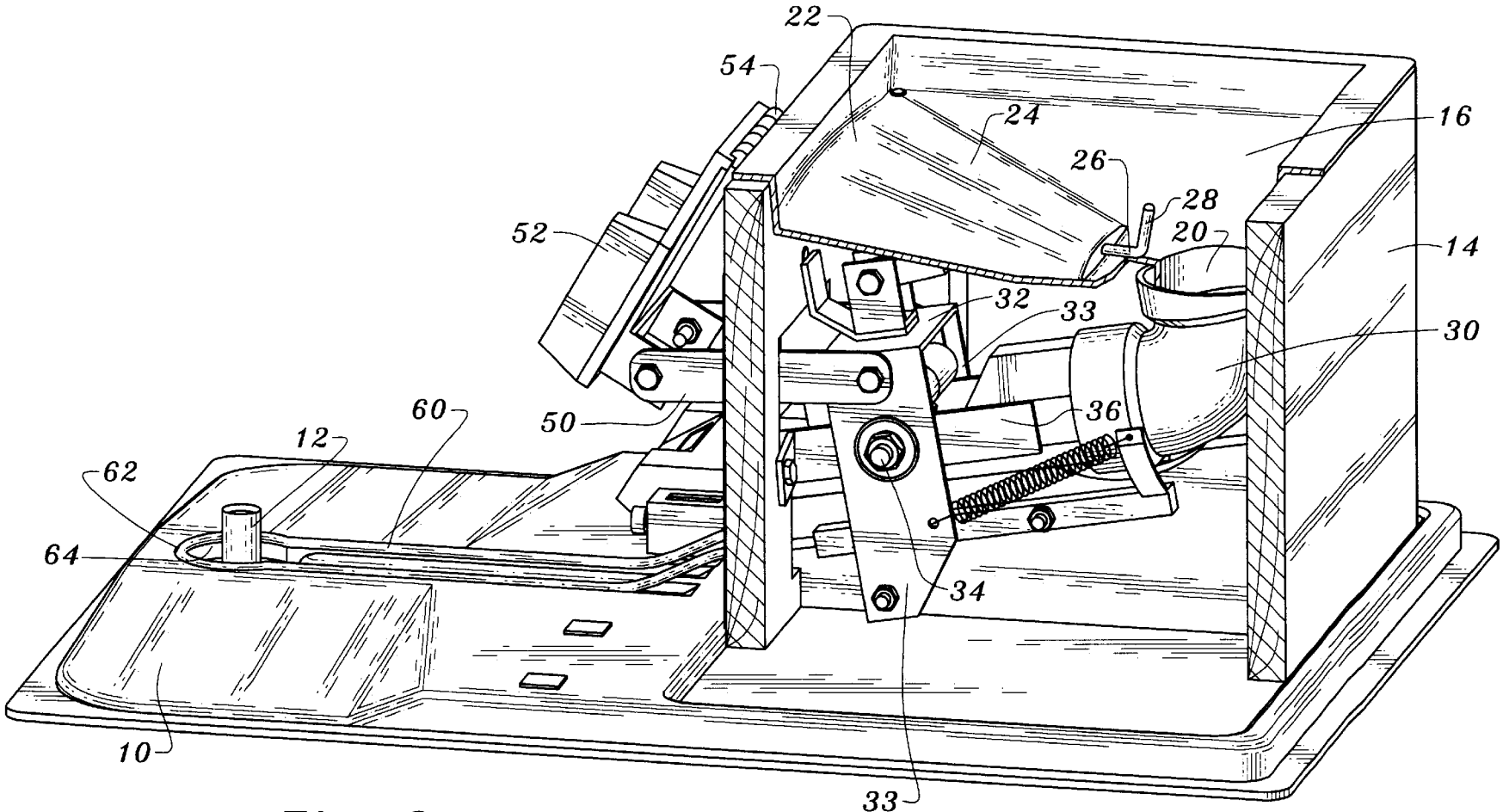
FIG. 3 is a perspective view in partial cross-section illustrating structural components of the apparatus.

Depression of club head engagement member 52 by a club head will result in inward movement of the member 52 as depicted by the arrow in FIG. 2. This will cause link arms 33 to rotate clockwise as viewed in FIG. 5. As pointed out above, this will result in release of an end-most golf ball on extension member 36 as well as move the anti-jam golf ball engagement member 26 to its extended position. In the arrangement illustrated, inward movement of the club head engagement member 52 is limited by engagement thereof with the external end of adjustment screw 46.

Upon exiting extension member 36 (see FIG. 5) the released or separated golf ball 18 will drop onto a track 50, which in the illustrated embodiment is in the form of a continuous loop of wire having a distal end 62 defining an aperture 64 for receiving the released golf ball. In FIG. 5 dash line representations of the golf ball show its progress along the track to the distal end and aperture defined thereby.

Figures 4, 4A:
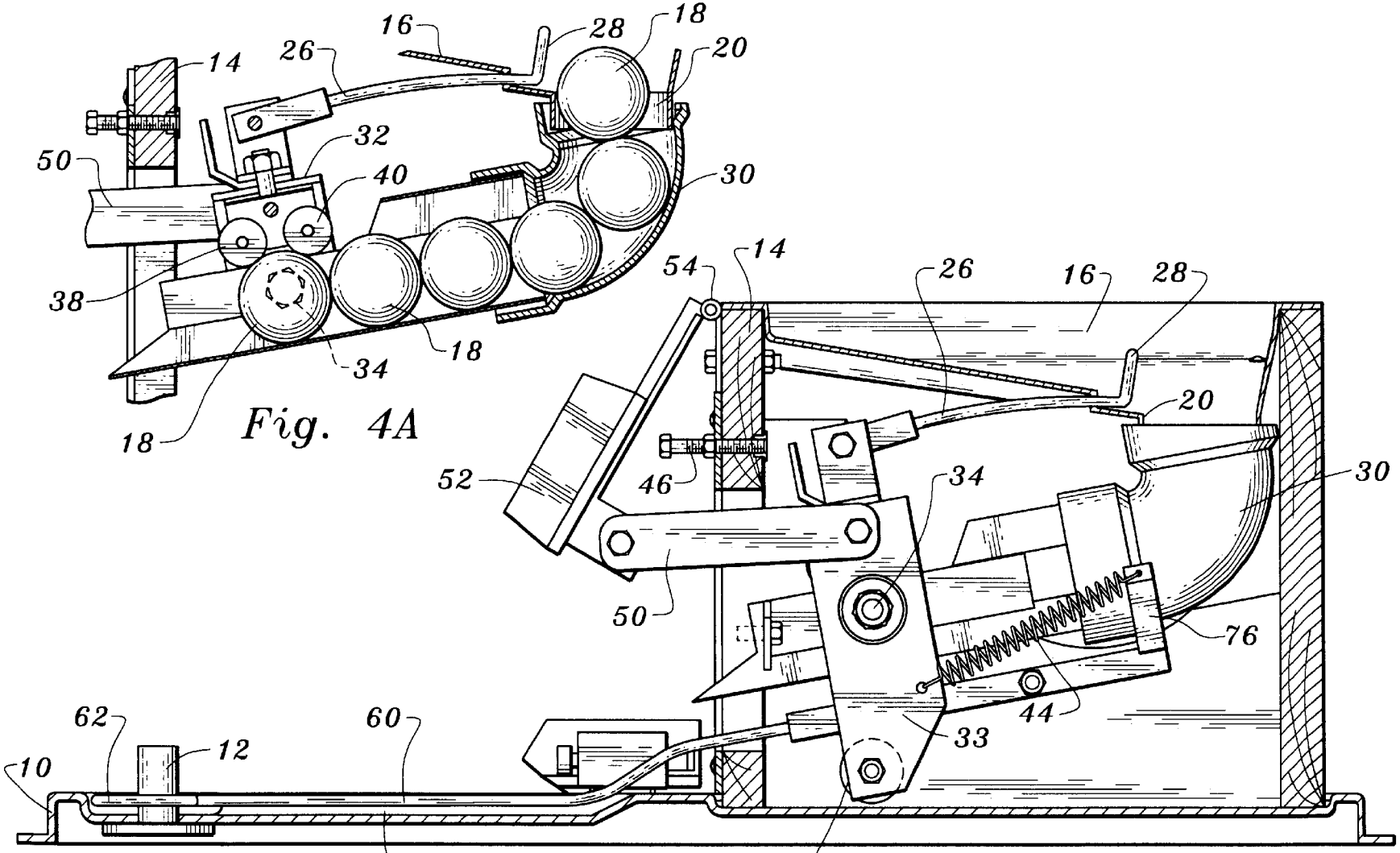
FIG. 4 is an enlarged cross-sectional view taken along the line 4—4 of FIG. 1.
FIG. 4A is a cross-sectional view illustrating the golf ball metering component of the apparatus and related structure in positions assumed when the situation shown in FIG. 4 exists.

The track is rotatably mounted about a pivot member 66 within the housing interior and movable between the position shown in FIG. 5, for example, wherein the distal end 62 is at an elevated position, and the position shown in FIG. 4, for example, wherein the distal end is at a lowered position. Movement to the distal end elevated position is accomplished by engagement of the track member by a roller 68 rotatably mounted at the bottom of one or both link arms 33. FIG. 4 shows roller 68 disengaged from the track and FIG. 5 shows roller 68 engaging the underside of the track and pivoting the track so that the distal end thereof rises. It is when the track is in this latter position or condition that the golf ball 18 is released onto the track. A bend 70 formed in the track will ensure that the golf ball has sufficient momentum to reach the distal end thereof.

It will be noted that when the track distal end is elevated, the aperture 64 defined thereby will be located over tee 12. When the track is tilted so that the distal end moves downwardly the tee 12 will pass through the aperture and will support the ball as shown in FIG. 6.

Base member 10 has an upper surface 72 and defines a recess 74 adjacent to the tee extending downwardly from the upper surface for accommodating the track with the track positioned below the upper surface to avoid impact by a golf club when the distal end of the track is in lowered position. In the arrangement illustrated, the recess 74 has a shape generally corresponding to the shape of the track.

The coil spring 44 interconnects a link arm 33 with that part of the track disposed within the interior of the housing 14. More particularly, the coil spring 44 is connected to an upperwardly projecting element 76 of the track. It will be seen that in the absence of pressure being exerted upon club head engagement member 52, the spring 44 will serve to continuously bias the track so that the distal end thereof is biased toward the lowered position.

The anti-jam feature of the invention located at the golf ball exit opening 20 of tray 16 will now be described in more detail. A golf ball engagement projection 80 is attached to tray 16 adjacent to opening 20, the projection projecting upwardly from the tray. This projection cooperates with member 46 and also with the walls of the tray to virtually ensure that no jamming at the opening by bridging golf balls will take place. FIGS. 7A through 7D illustrate the principles involved.

Figure 7A:
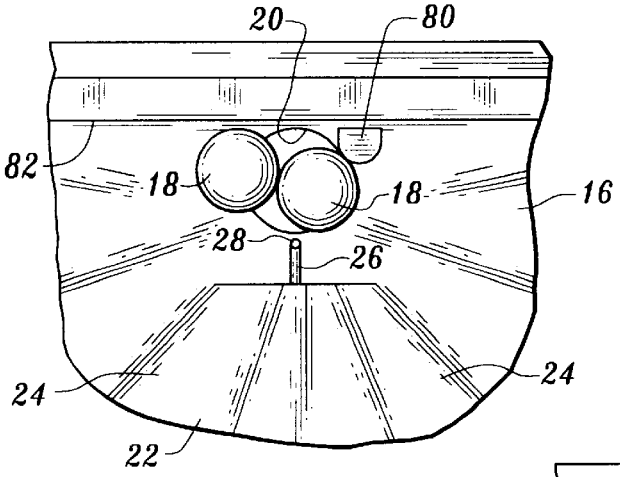
FIGS. 7A through 7D are plan views illustrating a portion of the golf ball support tray utilized in the apparatus and illustrating the anti-jam mechanism of the apparatus in sequential stages of operation.

FIG. 7A shows two golf balls 18 which have bridged over golf ball exit opening 20. One of these golf balls is closer to side 82 of the tray than the other. In fact, the left ball shown in FIG. 7A engages tray side 82 and the right ball golf ball 18 is kept away from the wall by projection 80.

Figure 7B:
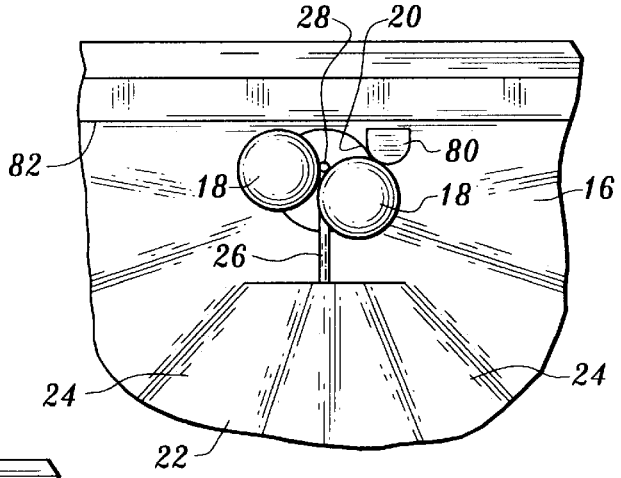
Figure 7C:
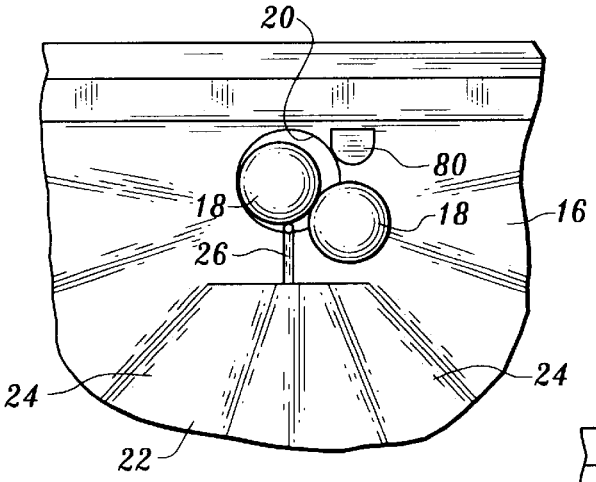

FIG. 7B shows anti-jam golf ball engagement member 26 having been moved to its extended position. The distal end 28 thereof is over opening 20 and is disposed somewhat at the backside of the right golf ball. That is, the right golf ball 18 will be simultaneously engaged by distal end 28 and projection 80.

Figure 7D:
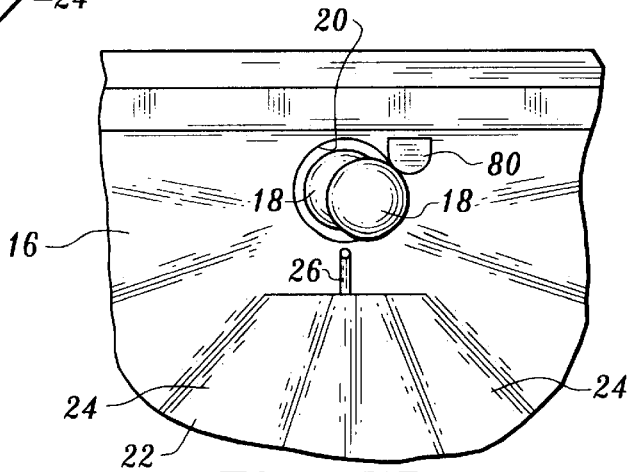

Retraction of the member 26 will exert a force on the right golf ball moving it sufficiently that the left golf ball 18 is free to drop into the hole. FIG. 7D shows only the single remaining ball 18, i.e. the formerly right ball, free to enter the opening 20 after passage of the left ball therethrough.

The illustrated embodiment of the invention incorporates a club head speed indicator 86 mounted on base member 10 adjacent to tee 12. Golf head speed indicators are known per se and any suitable commercially available indicator may be utilized. A counter 88 of any desired commercially available type is mounted next to the track 60. The counter includes a member 90 engageable by the track upon movement thereof to count the movements of the track and thus the number of balls dispensed and teed.

I claim:

1. Apparatus for serially dispensing and teeing golf balls, said apparatus comprising, in combination:

a golf ball support for supporting a plurality of golf balls, said support defining a golf ball exit opening;

pathway defining means defining a pathway for golf balls for receiving golf balls exiting the golf ball exit opening and for delivering the golf balls to a predetermined location spaced from said golf ball exit opening;

golf ball metering means disposed along said pathway defining means between said predetermined location and said golf ball exit opening for engaging an end-most golf ball of a plurality of golf balls lined up along said pathway and actuatable to separate said end-most golf ball from the other golf balls lined up along said pathway;

track means movably mounted adjacent to said golf ball metering means, said track means having a distal end movable between an elevated position and a lowered position, said track means defining an aperture at said distal end for receiving a golf ball from said metering means;

a tee;

tee mounting means;

actuator means operatively associated with said golf ball metering means to actuate said golf ball metering means and cause said golf ball metering means to separate the end-most golf ball from the other golf balls lined up along said pathway and deliver said separated golf ball to the distal end of said track means and over said aperture when said distal end is in elevated position and to cause said distal end to move from elevated position to lowered position whereby said tee projects upwardly through said aperture and receives the separated golf ball from said distal end to transfer the separated golf ball from said track means to said tee and biasing means continuously biasing said track means to urge the distal end of said track means toward said lowered position, said actuator means including movable mechanical linkage, said biasing means comprising a spring, and said spring and said track means being connected to said mechanical linkage and movable therewith.

2. The apparatus according to claim 1 additionally comprising an anti-jam golf ball engagement member movably mounted relative to said golf ball support for engaging and moving golf balls at said golf ball exit opening to prevent jamming of golf balls at said golf ball exit opening, said actuator means being operatively associated with said golf ball engagement member to cause movement of said anti-jam golf ball engagement member relative to said golf ball support.

3. The apparatus according to claim 1 wherein said tee mounting means comprises a base member having an upper surface and defining a recess adjacent to said tee extending downwardly from said upper surface for accommodating said track means with said track means positioned below said upper surface to avoid impact by a golf club when the distal end of said track means is in lowered position.

4. The apparatus according to claim 3 wherein said recess has a shape generally corresponding to the shape of said track means.

5. The apparatus according to claim 1 additionally comprising an anti-jam golf ball support for engaging and moving golf balls at said golf ball exit opening to prevent jamming of golf balls at said golf ball exit opening, said anti-jam golf ball engagement member being connected to said mechanical linkage and movable therewith.

6. The apparatus according to claim 1 wherein said actuator means includes movable mechanical linkage and wherein said golf ball metering means comprises tiltable rocker means connected to said mechanical linkage and movable therewith, said tiltable rocker means including first and second golf ball engagement elements, said mechanical linkage operable to tilt said tiltable rocker means between a first position wherein said first golf ball engagement element engages the end-most golf ball of a plurality of golf balls lined up along said pathway to block all of said plurality of golf balls from moving toward said predetermined location and a second position wherein said end-most golf ball is released by said tiltable rocker means to proceed toward said predetermined location and wherein the immediately adjacent golf ball of said plurality of golf balls is engaged by said second golf ball engagement element to prevent all but said end-most golf ball from proceeding toward said predetermined location.

7. The apparatus according to claim 6 wherein said first and second golf ball engagement elements each comprise a rotatably mounted roller.

8. The apparatus according to claim 2 wherein said golf ball support comprises a tray with tray walls sloping downwardly toward said golf ball exit opening and wherein said anti-jam golf ball engagement member has a golf ball engagement member distal end, said anti-jam golf ball engagement member movable by said actuator means between an extended position and a retracted position, said golf ball engagement member distal end being spaced from said golf ball exit opening when in said retracted position and positioned over said golf ball exit opening when in said extended position.

9. The apparatus according to claim 8 wherein said golf ball engagement member distal end projects upwardly and laterally relative to the path of movement of said anti-jam golf ball engagement member between said retracted and extended positions.

10. The apparatus according to claim 8 additionally comprising a golf ball engagement projection attached to said tray adjacent to said golf ball exit opening and projecting upwardly from said tray, said anti-jam golf ball engagement member and said projection being simultaneously engageable with a golf ball at said golf ball exit opening when at least two golf balls are located at said golf ball exit opening and when said anti-jam golf ball engagement member is in extended position and cooperable during movement of said anti-jam member from said extended position to said retracted position to move the golf ball simultaneously engaged by said golf ball engagement projection and said anti-jam golf ball engagement member in a direction away from said golf ball exit opening.

11. The apparatus according to claim 1 additionally comprising a club head speed indicator mounted adjacent to said tee.

12. The apparatus according to claim 1 wherein said actuator means includes a club head engagement member, pressure exerted on said club head engagement member by a club head operable to move said mechanical linkage against the bias exerted by said spring on said mechanical linkage.

13. The apparatus according to claim 12 wherein said actuator means includes a resilient club head engagement surface.

14. The apparatus according to claim 1 additionally comprising a counter cooperable with said track means for counting movements of said track means.

15. The apparatus according to claim 8 wherein one of said tray walls includes laterally sloping surfaces spaced from said golf ball exit opening for directing golf balls laterally relative to the path of movement of said anti-jam golf ball engagement member between said retracted and extended positions.

16. The apparatus according to claim 15 wherein said anti-jam golf ball engagement member is positioned in an aperture formed in the tray wall including said laterally sloping surfaces.

17. Apparatus for serially dispensing and teeing golf balls, said apparatus comprising, in combination:

a golf ball support for supporting a plurality of golf balls, said support defining a golf ball exit opening;

pathway defining means defining a pathway for golf balls for receiving golf balls exiting the golf ball exit opening and for delivering the golf balls to a predetermined location spaced from said golf ball exit opening;

golf ball metering means disposed along said pathway defining means between said predetermined location and said golf ball exit opening for engaging an end-most golf ball of a plurality of golf balls lined up along said pathway and actuatable to separate said end-most golf ball from the other golf balls lined up along said pathway;

track means movably mounted adjacent to said golf ball metering means, said track means having a distal end movable between an elevated position and a lowered position, said track means defining an aperture at said distal end for receiving a golf ball from said metering means;

a tee;

tee mounting means; and actuator means operatively associated with said golf ball metering means to actuate said golf ball metering means and cause said golf ball metering means to separate the end-most golf ball from the other golf balls lined up along said pathway and deliver said separated golf ball to the distal end of said track means and over said aperture when said distal end is in elevated position and to cause said distal end to move from elevated position to lowered position whereby said tee projects upwardly through said aperture and receives the separated golf ball from said distal end to transfer the separated golf ball from said track means to said tee, said actuator means including movable mechanical linkage and said golf ball metering means comprising tiltable rocker means connected to said mechanical linkage and movable therewith, said tiltable rocker means including spaced first and second freely rotatable golf ball engagement rollers spaced from one another, said mechanical linkage operable to tilt said tiltable rocker means between a first position wherein said first golf ball engagement roller engages the end-most golf ball of a plurality of golf balls lined up along said pathway to block all of said plurality of golf balls from moving toward said predetermined location and a second position wherein said end-most golf ball is released by said tiltable rocker means to proceed toward said predetermined location and wherein the immediately adjacent golf ball of said plurality of golf balls is engaged by said second golf ball engagement roller to prevent all but said end-most golf ball from proceeding toward said predetermined location, said first and second golf ball engagement rollers rolling along the outer surface of said end-most golf ball during tilting of said tiltable rocker means.

18. Apparatus for serially dispensing and teeing golf balls, said apparatus comprising, in combination:

a golf ball support for supporting a plurality of golf balls, said support defining a golf ball exit opening;

pathway defining means defining a pathway for golf balls for receiving golf balls exiting the golf ball exit opening and for delivering the golf balls to a predetermined location spaced from said golf ball exit opening;

golf ball metering means disposed along said pathway defining means between said predetermined location and said golf ball exit opening for engaging an end-most golf ball of a plurality of golf balls lined up along said pathway and actuatable to separate said end-most golf ball from the other golf balls lined up along said pathway;

track means movably mounted adjacent to said golf ball metering means, said track means having a distal end movable between an elevated position and a lowered position, said track means defining an aperture at said distal end for receiving a golf ball from said metering means;

a tee;

tee mounting means;

actuator means operatively associated with said golf ball metering means to actuate said golf ball metering means and cause said golf ball metering means to separate the end-most golf ball from the other golf balls lined up along said pathway and deliver said separated golf ball to the distal end of said track means and over said aperture when said distal end is in elevated position and to cause said distal end to move from elevated position to lowered position whereby said tee projects upwardly through said aperture and receives the separated golf ball from said distal end to transfer the separated golf ball from said track means to said tee;

an anti-jam golf ball engagement member movably mounted relative to said golf ball support for engaging and moving golf balls at said golf ball exit opening to prevent jamming of golf balls at said golf ball exit opening, said actuator means being operatively associated with said golf ball engagement member to cause movement of said anti-jam golf ball engagement member relative to said golf ball support, said golf ball support comprising a tray with tray walls sloping downwardly toward said golf ball exit opening and said anti-jam golf ball engagement member having a golf ball engagement member distal end, said anti-jam golf ball engagement member movable by said actuator means between an extended position and a retracted position, said golf ball engagement member distal end being spaced from said golf ball exit opening when in said retracted position and positioned over said golf ball exit opening when in said extended position, said golf ball engagement member distal end projecting upwardly and laterally relative to the path of movement of said anti-jam golf ball engagement member between said retracted and extended positions; and a golf ball engagement projection attached to said tray adjacent to said golf ball exit opening at a side of said golf ball exit opening and projecting upwardly from said tray, said anti-jam golf ball engagement member and said golf ball engagement projection being simultaneously engageable with a golf ball at said golf ball exit opening when at least two golf balls are located at said golf ball exit opening and when said anti-jam golf ball engagement member is in extended position and cooperable during movement of said anti-jam member from said extended position to said retracted position to move the golf ball simultaneously engaged by said golf ball engagement projection and said anti-jam golf ball engagement member in a direction away from said golf ball exit opening.

* * * * *